US007575332B2

(12) United States Patent
Cok

(10) Patent No.: US 7,575,332 B2
(45) Date of Patent: Aug. 18, 2009

(54) REMOVABLE FLAT-PANEL LAMP AND FIXTURE

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 355 days.

(21) Appl. No.: 11/158,151

(22) Filed: Jun. 21, 2005

(65) Prior Publication Data

US 2006/0285361 A1 Dec. 21, 2006

(51) Int. Cl.
*F21V 9/16* (2006.01)

(52) U.S. Cl. ..... 362/84; 362/147; 362/148; 362/150; 362/287; 362/249; 362/391

(58) Field of Classification Search ..... 362/84, 362/147, 647, 652, 287, 427, 249, 391, 657, 362/658, 659, 800, 148, 150
See application file for complete search history.

(56) References Cited

U.S. PATENT DOCUMENTS 3,504,172 A 3/1970 Libeman
4,418,973 A * 12/1983 Smetana et al. ..... 439/168
4,769,292 A 9/1988 Tang et al.
5,061,569 A 10/1991 VanSlyke et al.
6,565,231 B1 * 5/2003 Cok ..... 362/653
6,764,196 B2 * 7/2004 Bailey ..... 362/147
6,787,990 B2 * 9/2004 Cok ..... 313/504
6,819,036 B2 11/2004 Cok
7,303,305 B2 * 12/2007 Kennedy ..... 362/147
2002/0136001 A1 9/2002 Lefkovitz et al.
2003/0222558 A1 * 12/2003 Cok ..... 313/238
2003/0222559 A1 * 12/2003 Cok ..... 313/238
2004/0160768 A1 * 8/2004 Cok ..... 362/226
2005/0190569 A1 * 9/2005 Peng ..... 362/490

* cited by examiner

*Primary Examiner*—Sandra L O'Shea
*Assistant Examiner*—Jessica L McMillan
(74) *Attorney, Agent, or Firm*—Raymond L. Owens

(57) ABSTRACT

A flat-panel lamp and fixture system having a removable flat-panel lamp having at least two externally accessible electrode contacts and a suspended fixture for removably receiving at least one of flat-panel lamps and holding at least a portion of each of the flat-panel lamps above a portion of the suspended fixture. The system employs gravity to hold the at least one of flat-panel lamps in alignment having electrical connections for providing electrical connection to the at least two externally accessible electrode contacts.

16 Claims, 9 Drawing Sheets

REMOVABLE FLAT-PANEL LAMP AND FIXTURE

CROSS REFERENCE TO RELATED APPLICATIONS

Reference is made to commonly-assigned U.S. patent application Ser. No. 11/158,146 filed Jun. 21, 2005 (entitled "Removable Flat-Panel Lamp and Fixture" by Ronald S. Cok, the disclosure of which is incorporated herein.

FIELD OF THE INVENTION

This invention relates generally to area illumination and, more particularly, to power distribution and assembly in a flat-panel light fixture.

BACKGROUND OF THE INVENTION

Organic light emitting diodes are a promising solid-state lighting technology, combining area emission with a robust, flat structure well adapted to area illumination. Organic light emitting diodes (OLEDs) are manufactured by depositing organic semiconductor materials between electrodes on a substrate.

Referring to FIG. 12, an OLED device 10 includes a substrate 100 on which are deposited a first electrode 110, one or more organic layers 120, for example including a hole-injection layer, a hole-transport layer, a light-emitting layer, an electron-transport layer, an electron-injection layer, and a second electrode 130. An encapsulating cover 140 protects and seals the OLED device 10. Light 200 is emitted from the device either through the cover 140 (as shown) or through the substrate 100 (not shown) depending on the composition and transparency of the substrate 100, cover 140, and electrodes 110 and 130. Electrode contacts are electrically connected to the electrodes 110 and 130 to connect the OLED to a power source. A great variety of OLED devices, structures, organic layers, and material composition are described in the art. Such OLED devices enable the creation of light sources having extended surface area on a single substrate. The prior art describes the use of OLED devices in conventional lighting (for example U.S. Pat. 6,819,036 entitled "OLED Lighting Apparatus" by Cok, issued Nov. 16, 2004).

The lighting industry employs ceiling grids with luminaires, typically employing fluorescent lights, interspersed with fiber-composition panels in a suspended ceiling. For example, US20020136001 A1 entitled "Low-profile fluorescent luminaire and methods of installation" describes a low-profile fluorescent luminaire for attachment to a suspended ceiling and methods for retrofitting the luminaire to an existing lighting system. The low-profile fluorescent luminaire has lightweight "I"-shaped framework comprising a pair of transversely-extending end plates attached adjacent to opposed longitudinal ends of a longitudinally-extending spine. The spine and the end plates have a substantially coplanar arrangement to provide a low-profile structure that closely conforms to the ceiling. The "I"-shaped framework supports a reflector positioned below the spine and end plates when the luminaire is in a supported functional position. The low-profile luminaire can be retrofitted to a suspended ceiling to replace the existing light fixtures or to supplement the light output of an existing lighting system without modifying or removing the existing lighting fixtures. U.S. patent application Ser. No. 10/978,190 filed Oct. 29, 2004 entitled Heat Conducting Mounting Fixture for Solid-State Lamp by Giana Maria Phelan et al. describes the use of OLED lamps in a suspended ceiling and employs a thermally conductive mounting member and is hereby incorporated in its entirety by reference.

U.S. Pat. No. 3,504,172, granted Mar. 31, 1970, discloses a lighting fixture support and display device comprising an elongated channel having a top wall, vertically disposed side walls and a downwardly facing opening, said channel having an upper channel section and a lower channel section, an elongated plate disposed within said channel closing the upper channel section, means carried by said vertically disposed side walls engaging and supporting said plate, engagement of the last said means and said plate preventing outward displacement of said side walls, said plate having a plurality of openings spaced along its length and downwardly facing electric outlets carried in said openings, said upper channel retaining electric wiring for connecting said outlets to a source of electric energy, inwardly formed flanges carried by the lower edges of the side walls of said lower channel section, and a plurality of elongated closure elements removably carried in end to end relationship by said inwardly extending flanges to close said lower channel section, at least certain of said closure elements having openings for attachment of a pendant lighting fixture and switch means thereto, said fixture being provided with a plug for engaging one of said outlets to energize said fixture. However, there is no disclosure of providing power to flat-panel lamps in the fixture.

An important feature of suspended ceilings is the cost of removing or replacing faulty panels, particularly lamps mounted in the suspended ceilings. However, as described in the prior art, flat-panel lamps are not suitable for providing a simple and removable design for suspended ceilings. There is a need, therefore, for a flat-panel illumination system useful in suspended ceilings and providing a simple, safe, and reliable means of replacement and power distribution.

SUMMARY OF THE INVENTION

In accordance with one aspect there is provided a flat-panel lamp and fixture comprising:

a) a removable flat-panel lamp having at least two externally accessible electrode contacts; and b) a suspended fixture for removably receiving at least one of flat-panel lamps and holding at least a portion of each of the flat-panel lamps above a portion of the suspended fixture, employing gravity to hold the at least one of flat-panel lamps in alignment having electrical connections for providing electrical connection to the at least two externally accessible electrode contacts.

In accordance with another aspect of the present invention there is provided a flat-panel lamp and fixture comprising:

a) a removable flat-panel lamp having at least two accessible electrode contacts; and b) a suspended fixture for removably receiving a plurality of flat-panel lamps and holding at least a portion of each of the flat-panel lamps above a portion of the suspended fixture for supporting the removable flat-panel lamp in alignment with electrical connections to the at least two accessible electrode contacts.

ADVANTAGES

The present invention provides a simple, safe, and reliable means of replacement and power distribution for a flat-panel lamp in a suspended ceiling.

These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
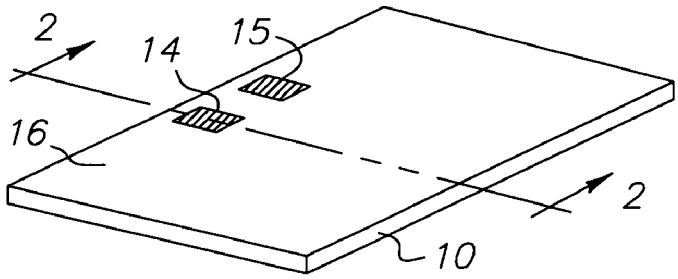
FIG. 1 is a perspective illustration of a flat-panel lamp according to one embodiment of the present invention.
Figure 2:
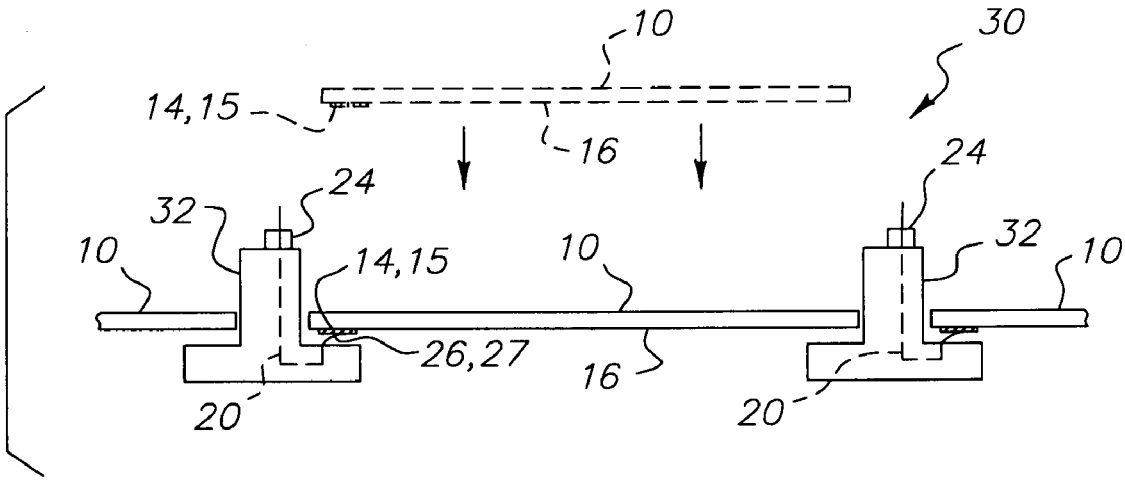
FIG. 2 is a partial cross-sectional view of a flat-panel lighting system according to an embodiment of the present invention.

Referring to FIGS. 1-4, a flat-panel lamp 10 and suspended ceiling system 30 comprise a removable flat-panel lamp 10 having at least two externally accessible electrode contacts 14, 15 on a bottom surface 16 of the flat-panel lamp 10. Support members 32, 33 are provided for removably receiving the flat-panel lamp 10 and holding at least a portion of each of the flat-panel lamps 10 above a portion of the support members 32, 33 employing gravity to hold the plurality of flat-panel lamps 10 in position. Support contacts 26, 27 are electrically connected to a single electrical receptacle 24 by associated electrical wires 20 within support member 32. Alternatively, a plurality of receptacles 24 may be employed (not shown). The receptacle 24 is capable of being connected to an electrical power source (not shown).

Figure 3:
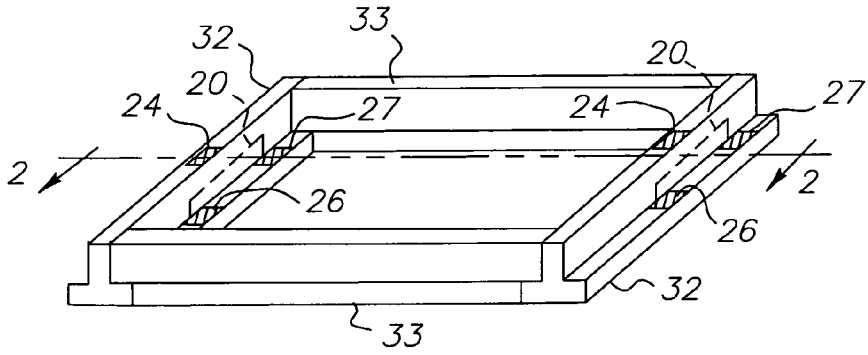
FIG. 3 is a perspective view of support members in one section of a flat-panel lighting system according to an embodiment of the present invention.
Figure 4:
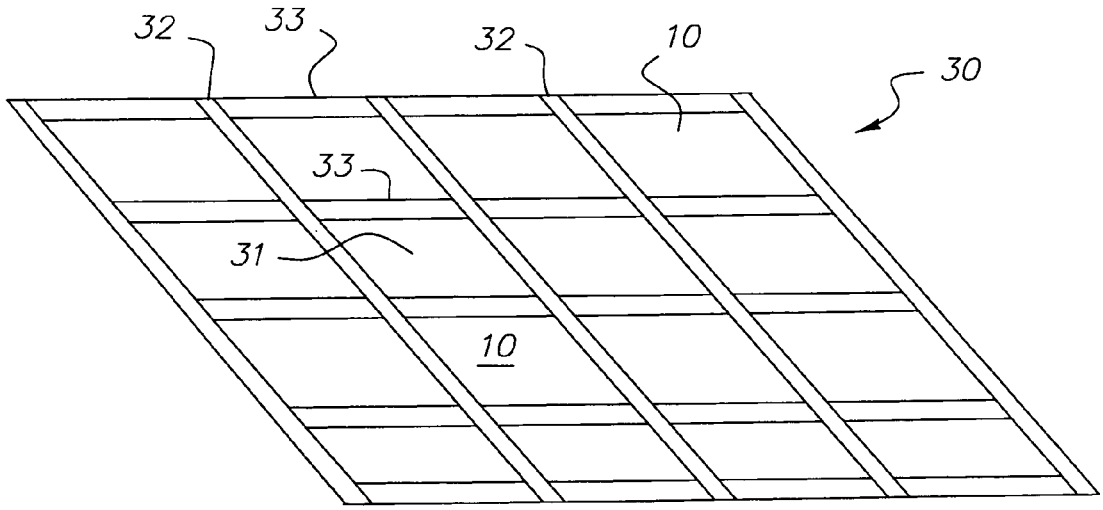
FIG. 4 is a perspective bottom view of a suspended ceiling system for holding a plurality of flat-panel lamps according to an embodiment of the present invention.

Referring to FIGS. 3 and 4, the support members 32, 33 may be a suspended ceiling system 30 comprising a grid of support members 32 and 33 between which one or more flat-panel lamps 10 may be positioned. The cross-sectional shape of the support member 32 and 33 will depend upon the type of electrical connection and support scheme as described below. In particular FIG. 3 illustrates a suspended ceiling system 30 having a single opening 31 wherein a single flat-panel 10 may be placed and FIG. 4 illustrates a suspended ceiling system 30 having a plurality of openings that holds one or more lamps 10 depending on the requirements of the room. Fiber-composition tile sections may be placed in the openings 31 where flat-panel lamps are not placed.

Referring back to FIGS. 1 and 2, the electrode contacts 14, 15 may be flat and coated on a substrate or cover of the flat-panel lamp 10 as shown in FIG. 1 on a bottom surface 16 of the flat-panel lamp 10. Support contacts 26, 27 electrically connected to the electrical receptacle 24 may deform under the pressure of the flat-panel lamp 10 to provide an electrical contact with positive pressure to the electrode contacts 14, 15 when the electrode contacts 14, 15 are brought into contact with the support contacts 26, 27. For example, when the flat-panel lamp 10 is in position within the support members 32, 33, the electrode contacts 14, 15 can rest on support contacts 26, 27 comprising deformable strips of metal on the support member 32 that is electrically connected through wires 20 to the electrical receptacle 24 and thence to an electrical supply, for example a household or commercial building power supply, such as 120 or 240 volts AC.

Figure 8A:
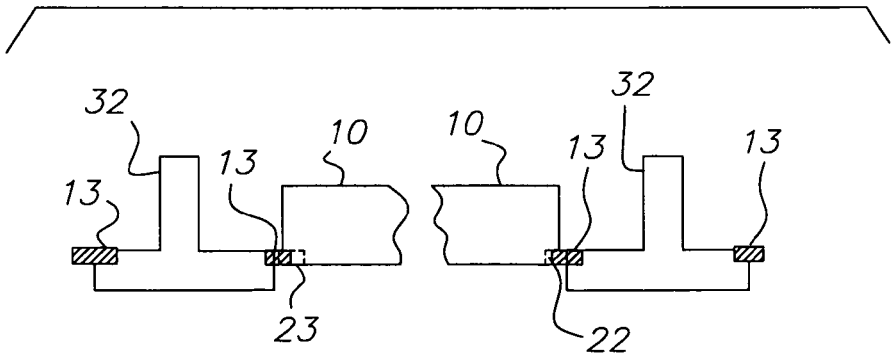
FIGS. 8*a* and 8*b* illustrate partial cross-sectional views of a portion of a flat-panel lighting system according to alternative embodiments of the present invention.
Figure 8B:
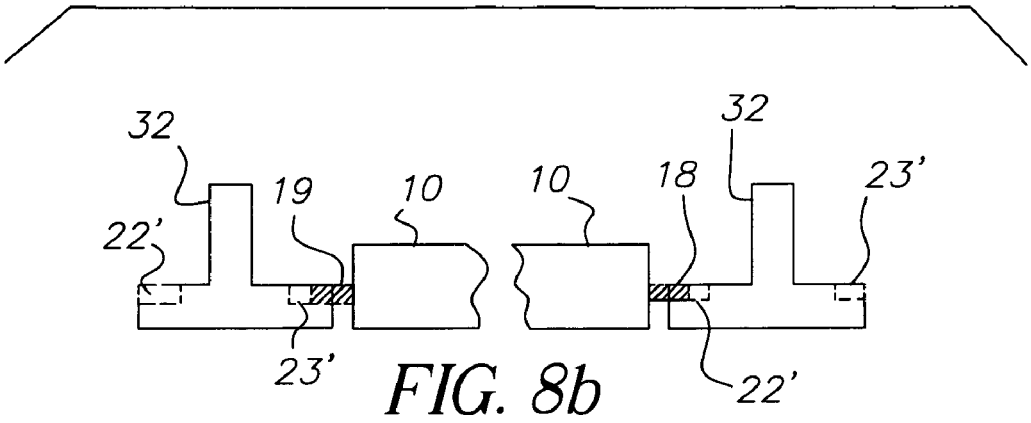

Alternatively, as shown in FIG. 8*a*, support contacts (e.g. pins 13) may protrude from a support member 32 and be received in recesses 22, 23 formed in the flat-panel lamp 10. In yet another alternative embodiment, as shown in FIG. 8*b*, protruding contacts 18 and 19 may protrude from the flat-panel lamp 10 and be received in recesses 22', 23' formed in a support member 32.

Figure 5A:
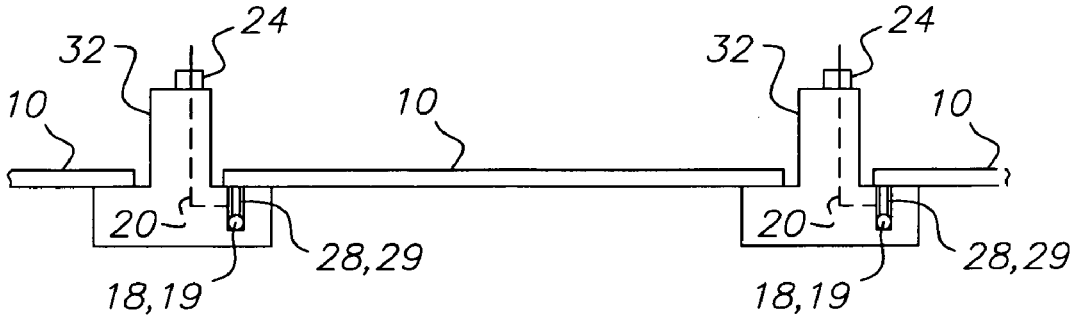
FIGS. 5*a-c* illustrate various views of a modified embodiment of the present invention comprising a partial cross-sectional view, a top view, and an enlarged partial cross sectional view.
Figure 5B:
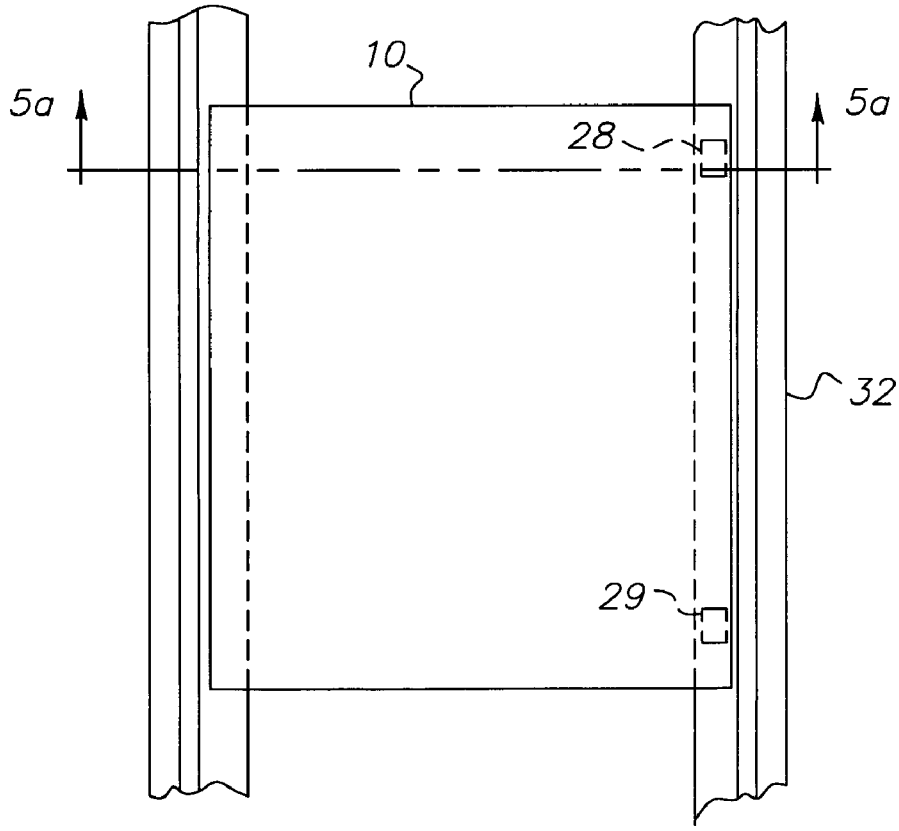
Figure 5C:
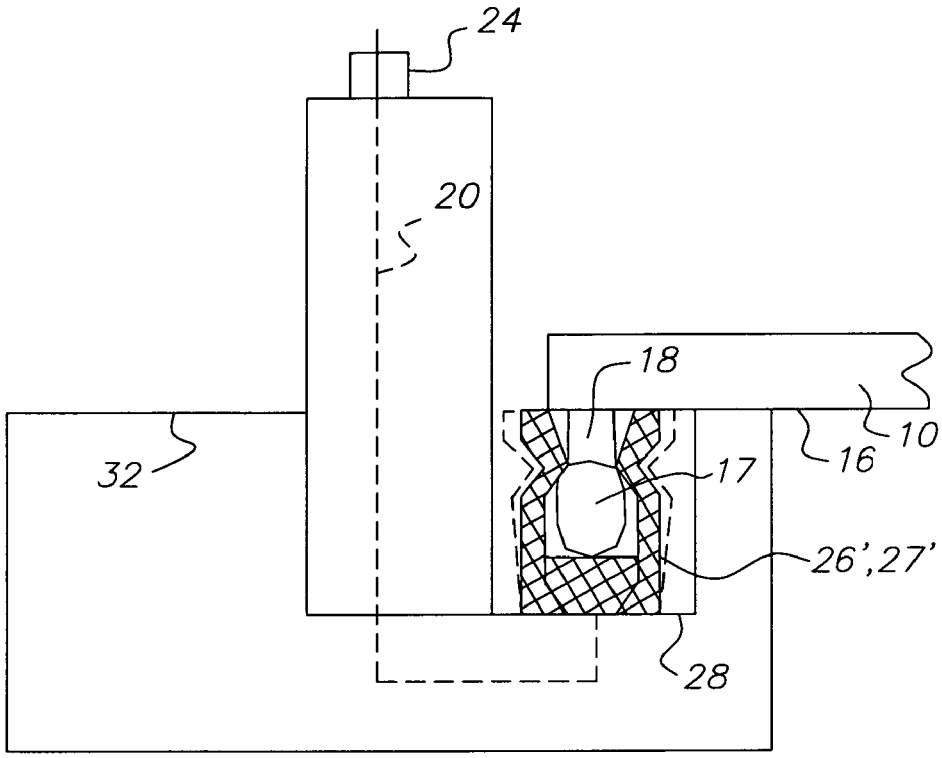

In other alternative embodiments of the present invention as shown in FIG. 5*a-c*, the flat-panel lamp 10 and suspended ceiling system 30 may employ protruding electrode contacts 18, 19 that protrude from the lower surface 16 of the flat-panel lamp 10 and electrical support contacts 26', 27' located within a socket 28 or sockets 28, 29 within the support member 32 to receive the protruding electrode contacts 18, 19. The electrical support contacts 26', 27' are electrically connected to electrical receptacle 24 by electrical wires 20 within member 32. Referring to the cross-sectional views of FIG. 5*a* and FIG. 5*c* and the top view of FIG. 5*b*, the protruding electrode contacts 18, 19 extend vertically from the surface of the flat-panel lamp 10. When the flat-panel lamp 10 is in operable position in support member 32, the electrode contacts 18, 19 are removably received in corresponding sockets 28, 29 formed in support member 32 that includes the electrical support contacts 26', 27'. The protruding electrode contacts 18, 19 may include a protruding terminal end 17, as shown, that can be caught and held securely by a corresponding deformable contacts 26', 27' secured to support member 32 to locate the flat-panel lamp 10 in position. This type of configuration assists in providing good electrical contacts between the electrodes 18, 19 and mating electrical support contacts 26', 27', but also allows release by a force easily exerted by the hand of an individual. As shown in FIG. 5*c*, the electrical support contacts 26', 27' are made of sheet metal in a configuration that allows deformation (as shown by dash lines) of the contacts during insertion and removal of the protruding terminal end 17 and its associated electrical support contact. Both electrode contacts 18 and 19 may be inserted into a single socket 28 that extends along the lamp 10 or, alternatively, separate sockets 28 and 29 may be employed for each electrode contact 18, 19. Moreover, the design of the corresponding sockets, the securing mechanism, and the shape of the contacts 18, 19, 26', 27' may vary.

Figure 6A:
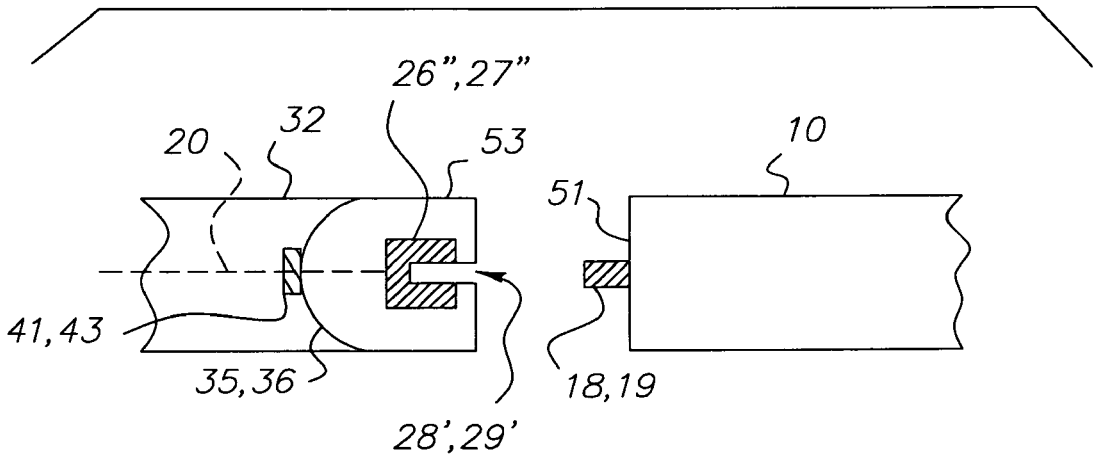
FIGS. 6*a-c* illustrate enlarged partial cross-sectional views of a flat-panel lighting system according to an alternative embodiment of the present invention.
Figure 6B:
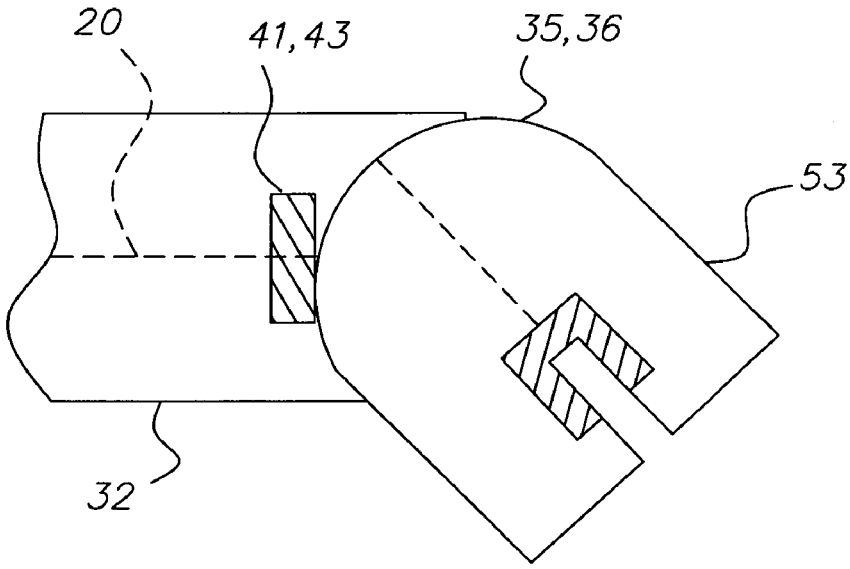
Figure 6C:
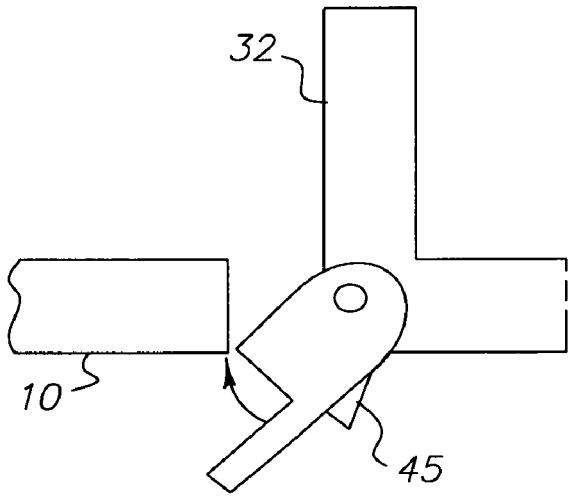

A wide variety of other methods may be employed to locate and hold a flat-panel lamp 10 within a support member 32 of a flat-panel lighting system while providing suitable electrical connections. For example, referring to FIGS. 6*a-c* in an alternative embodiment of the present invention for providing electrical connection between the lamp 10 and suspended ceiling system 30, like numerals indicating like parts and operation as previously discussed. In this embodiment the electrode contacts 18, 19 extend horizontally from an edge 51 of the flat-panel lamp 10 and sockets 28', 29' formed in a rotating member 53 in a corresponding support member 32. In this embodiment the support contacts 26", 27" are electrically connected to generally U-shaped elements 35, 36 in rotating member 53. The U-shaped elements 35, 36 in the rotating member 53 form electrical connections with an associate pair of electrical contacts 41, 43 in the support member 32. The associate electrical contacts 41, 43 connect to receptacle 24 through wires 20 as previously discussed. The associate electrical contacts 41, 43 maintain electrical contact with the U-shaped elements 35, 36 when in operative position, but need not maintain electrical contact when not in operative position. When a lamp is being installed or removed the support contacts 26", 27" electrically disengage electrode contacts 18, 19. Rotation of rotating member 53 allows insertion of the lamp 10 and once in the operative position a movable latch is used to support the other end of the lamp 10. As illustrated in FIG. 6*c* a movable latch 45 is provided for holding lamp in position during normal operation and for allowing removal or insertion of lamp 10 when the latch is in the non-engaged position.

Figure 7A:
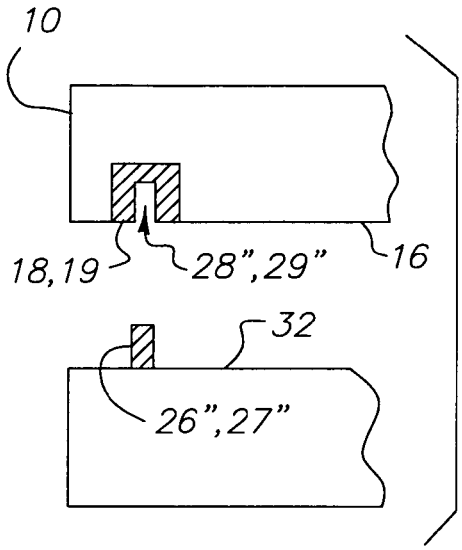
FIGS. 7*a* and 7*b* illustrate partial cross-sectional views of a portion of a flat-panel lighting system according to other alternative embodiments of the present invention.
Figure 7B:
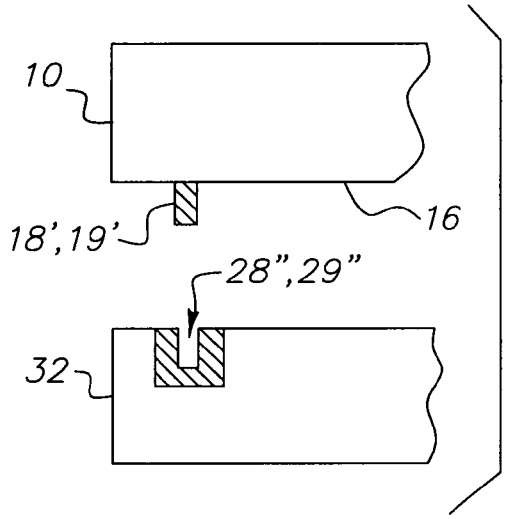

Referring to FIG. 7*a,* in yet another embodiment, the flat-panel lamp 10 may have sockets 28", 29" in which the electrode contacts 18, 19 are located on the bottom surface 16 rather than the edge of the flat-panel lamp 10 and the corresponding support member 32 may have protruding support contacts 26", 27" that are inserted into the socket openings when the flat-panel lamp 10 is in position. Alternatively as shown in FIG. 7*b,* protruding electrode contacts 18', 19' are provided on the bottom surface 16 of flat-panel lamp 10 and the sockets 28", 29" are provided on the support member 32.

Referring again to FIGS. 2, 3, and 4, an illustration of one method of inserting or removing lamp 10 in suspended ceiling system 30 is illustrated. First the flat-panel lamp 10 is inserted into the suspended ceiling system 30 by lifting the entire flat-panel lamp at an angle through openings 31 between supporting members 32, 33 of the suspended ceiling system 30 as illustrated by the dash lines (as is conventionally done to replace ceiling tiles in a suspended ceiling, for example). The flat-panel lamp 10 is aligned with the suspended ceiling system 30 and lowered down, as illustrated by the arrow until it rests in the support members 32, 33 with the electrode contacts 14, 15 in contact with the electrical support contacts 26, 27. Various mechanical or structural guides may be employed in the lamp 10 and/or support members 32, 33 of suspended ceiling system 30 to facilitate the alignment of the flat-panel lamp 10 with the suspended ceiling system 30. These guides may be integrally formed or attached to the lamp, lamp assembly, and/or support members.

Figure 9A:
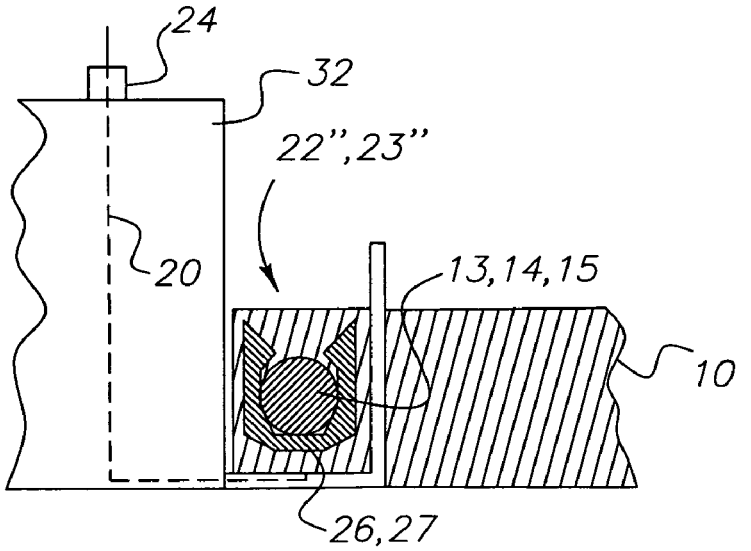
FIGS. 9*a* and 9*b* illustrate a partial cross-sectional view and a top view of an alternative electrode contact configuration in a flat-panel lighting system according to an embodiment of the present invention.
Figure 9B:
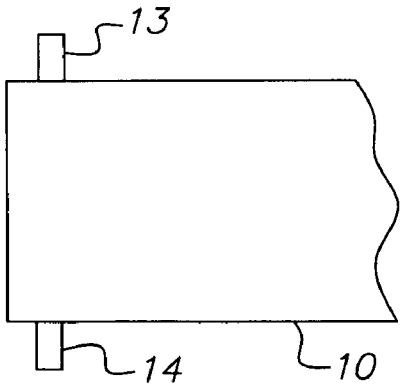
Figure 10:
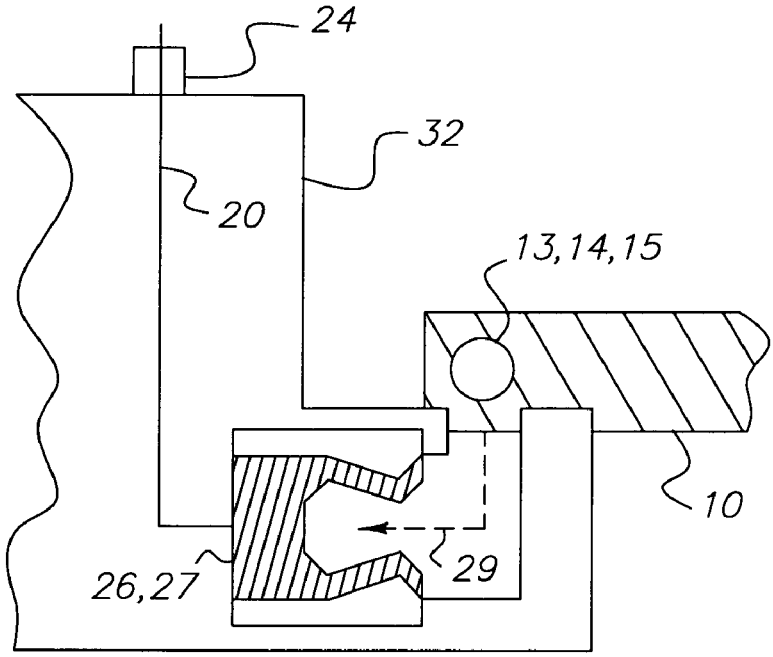
FIG. 10 is an enlarged partial cross-sectional view of an alternative electrode contact configuration in a flat-panel lighting system according to another embodiment of the present invention.
Figure 12:
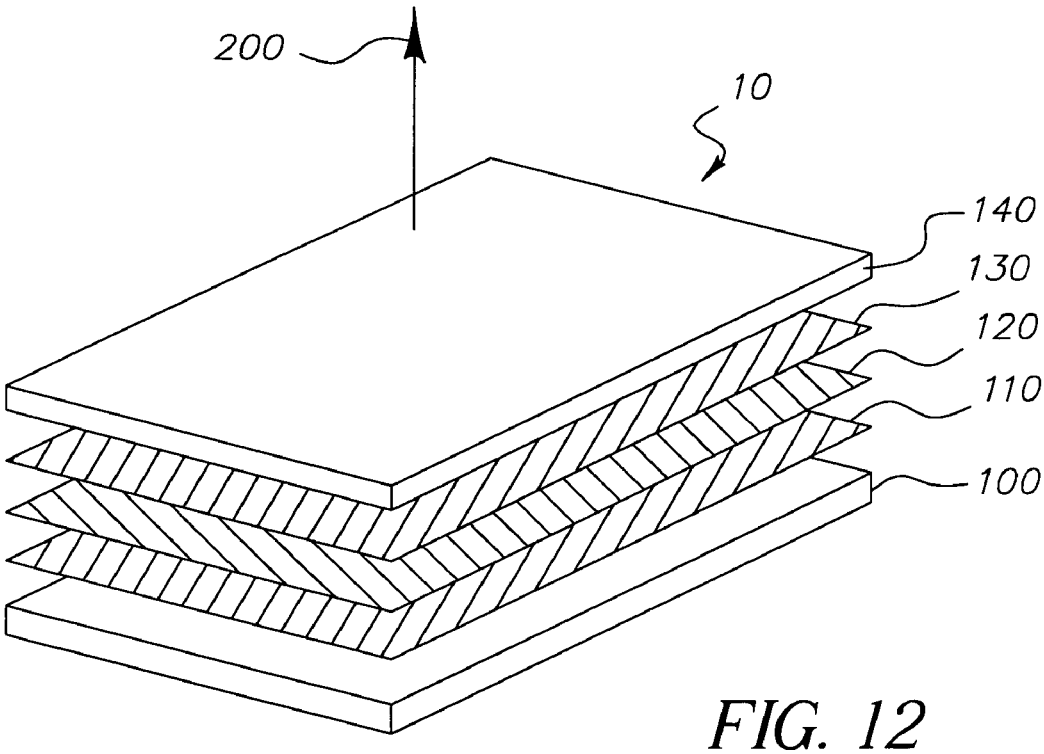
FIG. 12 is an exploded perspective illustration of a flat-panel lamp.

The present invention provides a simple way to remove and replace flat-panel lamps 10 within a suspended ceiling system 30 while providing a simple, robust, and safe connection to the electrical power grid. Electrical connections may be incorporated into the suspended ceiling system 30 to make the system extensible to arbitrary sizes and number of elements. In particular, electrical safety is important and it may be necessary to ensure that electrical connections are never exposed or readily touched by a person. Accordingly, the embodiment shown in FIGS. 5*a-c* provides such a safety feature. Alternative embodiments disclosed herein can be provided with additional safety features by locating the electrical connections within recesses that are not readily accessible to human touch. For example as shown in FIGS. 9*a* and 9*b,* a flat-panel lamp 10 with exposed electrode contacts 14, 15 formed as exposed pins may be placed in deeper recesses 22", 23" and the electrical connection to support contacts 26, 27 placed at the bottom of the resulting recess where it cannot be readily touched. Likewise as shown in FIG. 10, the support contacts 26, 27 may be made inaccessible to touch by placing them deep within a support member 32 having a channel into which the electrode contacts 14, 15 formed as pins 13 may be translated to prevent exposure of the electrical connections in support member 32.

Figure 11:
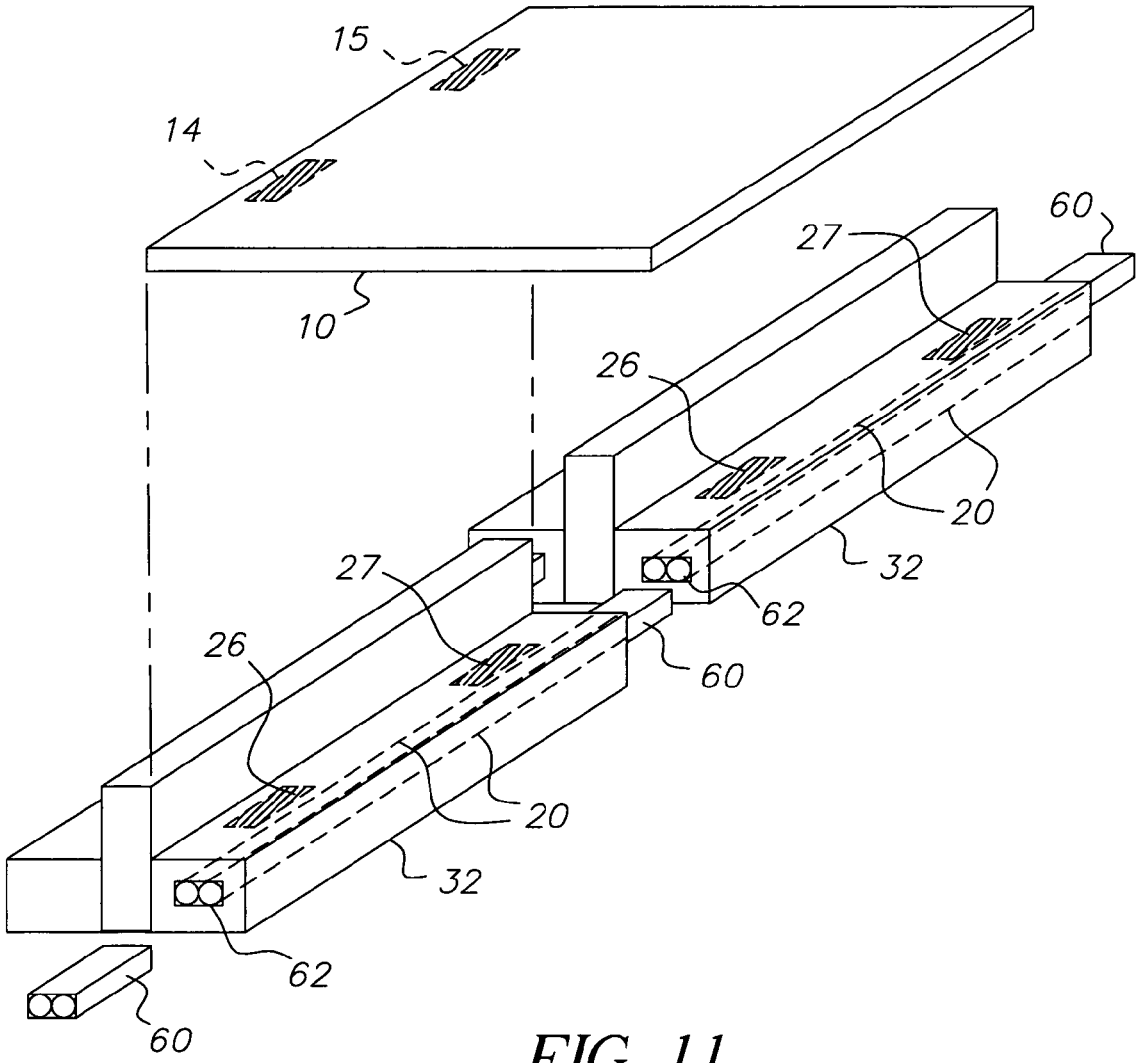
FIG. 11 is a perspective view of an electrical distribution in an extensible flat-panel lighting system according to another embodiment of the present invention.

The suspended ceiling system 30 may comprise a grid of support members 32 and 33 having integral electrical conductors to facilitate the distribution of power through the suspended ceiling system 30 and provide power to the flat-panel lamps 10 located in alignment on the support members 32 and 33. Referring to FIG. 11, the support members 32 may include electrical wiring for allowing continuous electrical connection between adjacent connecting members 32 comprising protruding electrical connector 60 that may be inserted into mating socket receptacle 62. The connector 60 is used to electrical connect adjoining support members 32. Within each member 32 wires 20 are provided for connecting electrical sockets 62 provided at each end of member 32 and for providing electrical connection with the appropriate contacts 26, 27. In this embodiment electrical power is provided by electrically connecting the sockets 62 in the last line of a designated series of lamps 10, the protruding electrical connector 60 electrically connecting one support member 32 to the next support member 32 when the protruding connectors 60 are inserted into the sockets 62. It is to be understood that each support member may have a single pair of contacts 26,27 for a single opening 31 or a plurality of associated contacts 26,27 for each opening 31 associated with the support member 32.

The flat-panel lamp 10 substrate may be rigid, for example comprising glass. Alternatively the lamp 10 may be flexible and comprise a flexible plastic substrate and or cover. A flexible OLED lamp or complementary fixture may also have a rigid perimeter support for supporting or holding the flexible lamp.

The present invention may also be practiced with either active- or passive-matrix OLED devices. In a preferred embodiment, the present invention is employed in a flat-panel OLED device composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light-emitting displays can be used to fabricate such a device, including both active- and passive-matrix OLED displays having either a top- or bottom-emitter architecture.

The invention has been described in detail with particular reference to certain preferred embodiments thereof, but it will be understood that variations and modifications can be effected within the spirit and scope of the invention.

PARTS LIST

10 flat-panel lamp
13 pins
14 electrode contact
15 electrode contact

16 bottom surface
17 protruding terminal end
18, 18' protruding electrode contact
19, 19' protruding electrode contact
20 wires
22 recess
22', 22" recess
23 recess
23', 23" recess
24 electrical receptacle
26 support contacts
26', 26" support contacts
27 support contacts
27', 27" support contacts
28 socket
28', 28" socket
29 socket
29', 29" socket
30 suspended ceiling system
31 opening
32 support member
33 support member
35, 36 U-shaped elements
41, 43 associate electrical contacts
45 movable latch
51 edge
53 rotating member
60 connector
62 socket
100 substrate
110 electrode
120 organic layers
130 electrode
140 cover
200 light

The invention claimed is:

1. A flat-panel lamp and fixture comprising:

a) a removable flat-panel lamp having at least two externally accessible electrode contacts;

b) a suspended fixture for removably receiving at least one flat-panel lamp and holding at least a portion of the flat-panel lamp above a portion of the suspended fixture, employing gravity to hold the at least one flat-panel lamp in alignment having electrical connections for providing electrical connection to the at least two externally accessible electrode contacts, wherein the electrode contacts are flat and wherein the electrical connections deform to provide an electrical contact to the electrode contacts when the electrode contacts we brought into contact with the electrical connections, and c) wherein said electrodes comprising pins protruding from the flat-panel lamp and said electrical connections comprise a detent formed in the fixture to receive the pins.

2. The flat-panel lamp and fixture according to claim 1 wherein the pin is an electrode contact and the detent includes an electrical connection.

3. A flat-panel lamp and fixture comprising:

a) a removable flat-panel lamp having at least two externally accessible electrode contacts;

b) a suspended fixture for removably receiving at least one flat-panel lamp and holding at least a portion of the flat-panel lamp above a portion of the suspended fixture, employing gravity to hold the at least one flat-panel lamp in alignment having electrical connections for providing electrical connection to the at least two externally accessible electrode contacts, wherein the electrode contacts are flat and wherein the electrical connections deform to provide an electrical contact to the electrode contacts when the electrode contacts are brought into contact with the electrical connections; and c) wherein said electrical connections comprise pins protruding from the fixture and said electrode contacts comprise detents formed in the flat-panel lamp to receive the pins.

4. The flat-panel lamp and fixture according to claim 3 wherein the pin is an electrode contact and the detent includes an electrical connection.

5. A flat-panel lamp and fixture comprising:

a) a removable flat-panel lamp having at least two externally accessible electrode contacts; and b) a suspended fixture for removably receiving at least one flat-panel lamp and holding at least a portion of the flat-panel lamp above a portion of the suspended fixture, employing gravity to hold the at least one flat-panel lamp in alignment having electrical connections for providing electrical connection to the at least two externally accessible electrode contacts, wherein the electrode contacts are flat and wherein the electrical connections deform to provide an electrical contact to the electrode contacts when the electrode contacts are brought into contact with the electrical connections, and wherein electrical power is provided between adjacent openings within said fixture.

6. The flat-panel lamp and fixture according to claim 5 wherein a plurality of adjacent support members are provided in said fixture each of said support member having an electrical connector for providing electrical connection with said adjacent said support member.

7. The flat-panel lamp and fixture according to claim 6 wherein a projecting member is provided between said adjacent support member for providing electrical connection between said electrical connector.

8. The flat-panel lamp and fixture according to claim 6 wherein said electrical connector comprises a socket for receiving a mating electrical projecting electrical connector.

9. A flat-panel lamp and fixture comprising:

a) a removable flat-panel lamp having at least two accessible electrode contacts;

b) a suspended fixture for removably receiving a plurality of flat-panel lamps and holding at least a portion of each of the flat-panel lamps above a portion of the suspended fixture for supporting said removable flat-panel lamp in alignment with electrical connections to the at least two accessible electrode contacts, wherein the electrode contacts are flat and wherein the electrical connections deform to provide an electrical contact to the electrode contacts when the electrode contacts are brought into contact with the electrical connections; and c) wherein said electrodes comprising pins protruding from the flat-panel lamp and said electrical connections comprise a detent formed in the fixture to receive the pins.

10. The flat-panel lamp and fixture according to claim 9 wherein the pin is an electrode contact and the detent includes an electrical connection.

11. A flat-panel lamp and fixture comprising:

a) a removable flat-panel lamp having at least two accessible electrode contacts;

b) a suspended fixture for removably receiving a plurality of flat-panel lamps and holding at least a portion of each of the flat-panel lamps above a portion of the suspended fixture for supporting said removable flat-panel lamp in alignment with electrical connections to the at least two accessible electrode contacts, wherein the electrode contacts are flat and wherein the electrical connections deform to provide an electrical contact to the electrode contacts when the electrode contacts are brought into contact with the electrical connections; and c) wherein said electrical connections comprise pins protruding from the fixture and said electrode contacts comprise detents formed in the flat-panel lamp to receive the pins.

12. The flat-panel lamp and fixture according to claim 11 wherein the pin is an electrode contact and the detent includes an electrical connection.

13. A flat-panel lamp and fixture comprising:

a) a removable flat-panel lamp having at least two accessible electrode contacts;

b) a suspended fixture for removably receiving a plurality of flat-panel lamps and holding at least a portion of each of the flat-panel lamps above a portion of the suspended fixture for supporting said removable flat-panel lamp in alignment with electrical connections to the at least two accessible electrode contacts, wherein the electrode contacts are flat and wherein the electrical connections deform to provide an electrical contact to the electrode contacts when the electrode contacts are brought into contact with the electrical connections; and c) wherein electrical power is provided between adjacent openings with said fixture.

14. The flat-panel lamp and fixture according to claim 13 wherein a plurality of adjacent support members are provided in said fixture each of said support member having an electrical connector for providing electrical connection with said adjacent said support member.

15. The flat-panel lamp and fixture according to claim 14 wherein a projecting member is provided between said adjacent support member for providing electrical connection between said electrical connector.

16. The flat-panel lamp and fixture according to claim 14 wherein said electrical connector comprises a socket for receiving a mating electrical projecting electrical connector.

* * * * *